United States Patent [19]

Heyes

[11] 4,294,627

[45] Oct. 13, 1981

[54] TREATMENT OF TINPLATE SURFACES

[75] Inventor: Peter J. Heyes, Swindon, England

[73] Assignee: Metal Box Limited, Reading, England

[21] Appl. No.: 153,910

[22] Filed: May 28, 1980

[30] Foreign Application Priority Data

Jun. 7, 1979 [GB] United Kingdom ..... 19793/79
Apr. 25, 1980 [GB] United Kingdom ..... 13748/80

[51] Int. Cl.[3] ..... C23F 7/02
[52] U.S. Cl. ..... 148/6.14 R; 148/6.15 R
[58] Field of Search ..... 148/6.14 R, 6.15 R, 148/6.15 Z; 204/145 R

[56] References Cited

U.S. PATENT DOCUMENTS 1,658,222 2/1928 Burns et al. ..... 204/145 R
1,710,743 4/1929 Pacz ..... 148/6.27
1,917,022 7/1933 Dunn ..... 204/145 R
2,820,731 1/1958 Heinzelman et al. ..... 148/6.15 Z
3,682,713 8/1972 Ries ..... 148/6.14 R

*Primary Examiner*—Ralph S. Kendall
*Attorney, Agent, or Firm*—Diller, Ramik & Wight

[57] ABSTRACT

A metal surface, particularly a tinplate surface of a can for canned food, is treated by contact with a solution containing a zirconium compound, particularly ammonium zirconium carbonate or zirconium acetate. An inorganic salt may also be present in the solution. The concentration of the zirconium compound, calculated as $ZrO_2$, is in the range between 0.1 and 10% w/w. The surface is thereafter heated to a temperature in the range between 20° and 300° C. until it is dry. The surface may be cleaned prior to contact with the solution. In this way a coating is provided on the surface which improves the stain resistance of the surface.

8 Claims, No Drawings

TREATMENT OF TINPLATE SURFACES

This invention relates to a method of treating a metal surface, particularly so as to protect the surface from sulphide staining. The invention also includes within its scope a surface which has been so treated and an article, particularly a can, having such a surface.

Untreated tinplate develops a dark irregular stain when in contact with a range of sulphur-bearing natural products under the conditions used in food processing. Sulphur-bearing proteins are present in many foods which are preserved in cans, and after processing the interior surface of the can is often discoloured to a marked degree due to the formation of metal sulphides, while the food in contact with such discoloured areas may itself become stained. The stain appears to be harmless, but is objectionable and should be avoided.

It is common practice to improve corrosion and stain resistance characteristics and paint bonding qualities of a metal surface by depositing on it a protective coating, known as a conversion coating, for example the treatment known as passivation in the tinplate industry. It is also known to subsequently treat the surface having the conversion coating to improve the qualities of the coating.

Conventionally the conversion coating for a variety of metals consists of a solution of phosphoric acid containing zinc oxide, chromic acid or soluble fluorides, depending upon the metal to be treated. Subsequent rinsing treatment usually consists of chromic acid and a soluble fluoride.

In view of the toxic nature of chromium VI compounds, it would be preferable to use an alternative, non-toxic material to produce a stain-resistant finish to tinplate. This is particularly important in the treatment of drawn plain containers.

Tin sulphide staining generally occurs where the tinplate surface is unprotected by a passivation film of the 'cathodic dichromate' type. It takes the form of uneven discolouration of the surface and is expected on unlacquered two-piece containers because the passivation films are destroyed by the forming operations. Iron sulphide forms where the tinplate steel base is exposed in the headspace above a sulphur-bearing food product. The stains are black and can become detached from the tinplate. Unlacquered twopiece cans are highly susceptible to iron sulphide staining because the tin coating applied by the tinplate manufacturers is severely disrupted during the forming operation. Generally, where a product is believed to give rise to iron sulphide staining, lacquers are used to prevent the unsightly black stain forming.

It has been found that zirconium compounds are useful as components in conversion coating systems, which provide metal surfaces with some corrosion protection. The use of zirconium-containing materials, generally in conjunction with conventional phosphating processes is described in, for example, British Patent Specification No. 1,479,638. Some of the treatments described, it is claimed, improve the adhesion to subsequently applied lacquers.

It has also been proposed in British Patent Specifications Nos. 479,681 and 479,746 to prevent sulphide-staining of tinplate by anodic polarisation in dilute ammonia, ammonium carbonate or alkali metal phosphates. It is suggested that this treatment produces a stable tin oxide film that prevents the formation of metal sulphides during processing of food.

The most effective of the above-mentioned treatments involves the use of the toxic chromium VI compounds. The object of the present invention is to obviate the need for toxic chromium compounds whilst providing an equally or more effective treatment method.

According to the invention, a method of treating a metal surface comprises the steps: contacting said surface with a solution free of organic polymeric materials and comprising a solvent and a zirconium compound at a concentration, calculated as $ZrO_2$, in the range between 0.1 and 10% w/w; and thereafter heating said surface to a temperature in the range between 20° and 300° C. until said surface is dry, said surface being capable of wetting by said solvent.

The solution may further comprise an inorganic salt, such as a phosphate, particularly $Na_3PO_4$ or a silicate, particularly $Na_2SiO_3$, or a borate.

The zirconium compound is preferably ammonium zirconium carbonate (hereinafter referred to as AZC), or zirconium acetate, and is preferably at a concentration, calculated as $ZrO_2$, in the range between 0.2 and 2% w/w. The surface is preferably tinplate and the solvent is preferably water.

The method may comprise the further step of cleaning said surface, so as to make it capable of wetting by said solvent, prior to said contacting step. The cleaning step may comprise passing a current between said surface and an auxiliary electrode in said solution.

The invention will now be described by way of example only in the following examples. Two AZC solutions were obtained from a major UK supplier, Magnesium Elektron; one simply AZC, and the other a stabilised form, Bacote 20 containing traces of tartrate and citrate. Both solutions contain 20% w/w $ZrO_2$. Most of the subsequent work involved Bacote 20.

After treatment in the solutions containing the zirconium compounds, the samples underwent a sulphide-staining test. They were placed in a dried pea and brine staining medium and heated to 121° C. in a pressure cooker for one hour. The degree of staining was assessed visually. Some samples were examined in a scanning electron microscope using an X-ray analyser.

EXAMPLE 1

To establish the conditions under which a sulphide stain-resistant finish can be produced on drawn tinplate using AZC, the following experiments were made.

Unwashed, drawn and wall-ironed (DWI) can sections were solvent cleaned by immersion in butyl cellosolve, followed by washing in hot (>90° C.) 25% Decon 90 solution and a distilled water rinse. The sections were then immersed in stabilised AZC solutions (0.002 to 20% w/w $ZrO_2$) for a few seconds. The specimens were dried in an oven at 100° C. Similarly cleaned sections were briefly immersed in a dilute AZC solution (0.5% w/w $ZrO_2$) and dried at temperatures ranging from 20° to 300° C.

The effectiveness of each treatment was assessed by subjecting the sample to the sulphide-staining test mentioned above. The results are shown in Table 1.

TABLE 1

SULPHIDE STAINING OF AZC TREATED DWI CAN SECTIONS

| Concentration of AZC | | Oven Temperature | Sulphide |
|---|---|---|---|
| As Bacote 20(%) | As $ZrO_2$(%) | (°C.) | Stain* |
| 100 | 20 | 100 | 3–4 |
| 50 | 10 | 100 | 3–4 |
| 10 | 2 | 100 | 1 |
| 5 | 1 | 100 | 1 |
| 2.5 | 0.5 | 100 | 1 |
| 1 | 0.2 | 100 | 2–3 |
| 0.5 | 0.1 | 100 | 3–4 |
| 0.1 | 0.02 | 100 | 4–5 |
| 0.01 | 0.002 | 100 | 4–5 |
| 2.5 | 0.5 | 20 | 2 |
| 2.5 | 0.5 | 50 | 1 |
| 2.5 | 0.5 | 150 | 1–2 |
| 2.5 | 0.5 | 200 | 1–2 |
| 2.5 | 0.5 | 250 | 1–2 |
| 2.5 | 0.5 | 300 | 1–2 |
| Untreated DWI samples | | | 5 |

*Staining
1 None
2 Slight
3 Borderline acceptability
5 Severe (as received samples)

It is thus apparent that adequate sulphide stain resistance can be achieved by briefly immersing clean tinplate in an AZC solution of $ZrO_2$ content between 0.1 and 10% and drying at temperatures between 20° and 300° C. The $ZrO_2$ content is preferably between 0.2 and 2% w/w.

The results indicate that a protective film was produced on the clean surface when a dilute AZC solution was dried on the drawn tinplate. The film once formed was not destroyed by rinsing the can in water and redrying. The stain resistance did not arise either when undiluted AZC was dried or when the dilute AZC was not dried before staining. Of the specimens examined in the scanning electron microscope after staining, only those that did not stain had detectable zirconium on the surface.

The interaction that produces stain resistance occurs during the decomposition of the dilute AZC solution on the metal surface. A possible explanation of this effect may lie in the strong affinity of zirconium for oxygen. The decomposition of the AZC complex may allow the zirconium to attach to the tin oxides on the surface.

This bonding is likely to be strong and the complex zirconium oxide-tin oxide structure sufficiently stable to prevent sulphide ions reacting with the tin oxide during processing.

Zirconium was detected on the surface of stain-resistant, treated samples. It is most likely that it would be present as an oxide as it is not possible to electrodeposit zirconium metal from aqueous solutions.

EXAMPLE 2

Table 2 shows the results obtained when as received (uncleaned) sections cut from 211×400 plain tinplate cans, drawn and redrawn (DRD) using a lubricant, were treated in Bacote 20 and dilute Bacote 20 (1% $ZrO_2$). Only the cathodically polarised specimen, subsequently rinsed in dilute Bacote 20 and dried before staining, had an adequate stain resistance.

TABLE 2

SULPHUR STAIN RESISTANCE OF DRD CAN SECTIONS TREATED IN AZC (BACOTE 20)

| SPECIMEN | TREATED IN BACOTE 20 | RINSE | DRY-ING | SUL-PHUR STAIN* |
|---|---|---|---|---|
| B | None | — | — | 5 |
| 1 | Immersion | Dilute B20 | Oven | 4–5 |
| 2 | Cathodic | Dilute B20 | Oven | 2 |
| 3 | None | Dilute B20 | Oven | 5 |

*See Table 1

It is therefore apparent that sulphide stain resistance can be conferred to drawn tinplate when a dilute AZC solution dries on a clean surface. If the sample is not cleaned before immersion in AZC, the cathodic polarisation is required to allow adequate wetting of the metal surface. The current does not produce the surface active species, but merely cleans the surface of any corrosion-resistant (oil) coatings which have been applied, for example by the manufacturer, or of any lubricants which have been applied to the surface, e.g. in can-drawing. This electrolytic cleaning need not be carried out separately in an undiluted Bacote 20 solution, but could be carried out in situ in the dilute Bacote 20 solution, thus obviating the need for a separate cleaning step. If the cleaning step is to be carried out separately, then other cleaning means, e.g. solvents could be used.

EXAMPLE 3

A DWI can section, cleaned as described in Example 1, was immersed in a solution of zirconium acetate at a concentration (calculated as $ZrO_2$) of 0.5% w/w and then dried in an oven at 100° C. The sample was then subjected to the sulphide-staining test and showed a resultant staining (referring to the scale in Table 1) of 2.

EXAMPLE 4

Conventionally, tinplate when received from the manufacturers has already been subjected to a passivation treatment, and in the previous Examples such passivated tinplate was used, the drawing processes described in those Examples destroying the effectiveness of any coatings on the tinplate.

In this Example unpassivated undrawn electrolytic tinplate was solvent-cleaned, as described in Example 1, then immersed in an AZC solution (0.5% w/w $ZrO_2$), and then dried in an oven at 100° C. When subjected to the sulphide-staining test, this sample showed a staining of 1 (refferring again to the scale in Table 1). A control, being as received unpassivated undrawn tinplate, which was not treated with AZC, when subjected to the same test showed a staining of 5.

EXAMPLE 5

211×400 DRD (drawn and redrawn) cans were cleaned internally by cathodic treatment in 5 g/l solution of $Na_2CO_3$, washed in distilled water and filled with the zirconium-containing solution. This solution was allowed to contact the whole can wall briefly before being poured out and reused. The cans were dried in an oven at 120° C.

The results are shown in the Table 3 below.

TABLE 3

| Solution Composition | | | Degree of Sulphide Staining* | |
|---|---|---|---|---|
| $ZrO_2$ content % | Inorganic | % | Tin | Iron |
| 2 | $Na_3PO_4$ | 1.5 | 1 | 2 |
| 2 | $Na_3PO_4$ | 1 | 1 | 1 |
| 2 | $Na_2SiO_3$ | 1 | 1 | 2 |
| 2 | $Na_2SiO_3$ | 0.75 | 2 | 2 |
| 1 | $Na_2SiO_3$ | 0.75 | 1 | 1 |
| 2 | — | | 1 | 4 |
| 2 | $Na_2B_4O_7$ | 1 | 2 | 3 |
| 2 | $K_2B_4O_7$ | 1 | 2–3 | 1–2 |
| 2 | $NaH_2PO_4$ | 1 | 2 | 4 |
| 2 | $KH_2PO_4$ | 1 | 2 | 4 |
| 2 | $NH_4H_2PO_4$ | 1 | 1–2 | 4 |

*Degree of sulphide staining
1 Negligible
2 Slight
3 Borderline acceptability
4 Moderate
5 Severe The above results indicate that additions of inorganic salts, particularly sodium silicate or trisodium phosphate can improve the iron sulphide staining resistance of drawn tinplate without seriously impairing the tin sulphide stain performance.

Although in the above Examples, reference has been made to immersion of the surface in the solution containing a zirconium compound, it will be apparent that any other means, for example spraying, of contacting the surface with the solution are equally feasible.

Summarising, zirconium compounds, particularly AZC and zirconium acetate, are capable of giving acceptable sulphide stain resistance to clean tinplate. The mechanism is not electrolytic and the only requirement is that a dilute AZC solution should dry in contact with the surface. The addition to the zirconium-containing solution of inorganic salts is also shown to be advantageous.

An immediate application for the invention might be in the treatment of DWI food cans, as either a replacement for chromate in the washer or preferably in place of the oil in the bodymaker. The latter course, if feasible, would reduce the size of the washer required. DWI food cans, successfully treated with AZC or zirconium acetate, would not require internal spray lacquering for some applications, and the cost of the lacquer could be saved.

The use of zirconium compounds to replace chromates in tinplate strip passivation would remove the cost of electricity and the equipment needed to provide a current and that required to ensure removal of toxic materials from the rinse water.

The method of the present invention is thus advantageous both practically and economically.

I claim:

1. A method of treating a tinplate surface comprising the steps: wetting said tinplate surface with a solution free of organic polymeric materials and consisting essentially of a solvent, and a zirconium compound selected from the group consisting of ammonium zirconium carbonate and zirconium acetate at a concentration, calculated as $ZrO_2$, in the range between 0.1 and 10% w/w; and thereafter heating said tinplate surface to a temperature in the range between 20° and 300° C. until said surface is dry.

2. A method according to claim 1, wherein said solution also contains a minor amount of an inorganic salt selected from the group consisting of phosphates, silicates and borates.

3. A method according to claim 1 or claim 2, wherein said zirconium compound is ammonium zirconium carbonate.

4. A method according to claim 1 or claim 2, wherein said zirconium compound is zirconium acetate.

5. A method according to claim 1 or claim 2, wherein the concentration of said zirconium compound, calculated as $ZrO_2$, is in the range between 0.2 and 2% w/w.

6. A method according to claim 1 or claim 2, wherein said solvent is water.

7. A method according to claim 1 or claim 2, further comprising cleaning said tinplate surface, so as to make it capable of wetting by said solvent, prior to said wetting step.

8. A method according to claim 7, wherein said cleaning step comprises passing a current between said tinplate surface and an auxiliary electrode in said solution.

* * * * *